US005331835A

United States Patent [19]

Palma et al.

[11] Patent Number: 5,331,835

[45] Date of Patent: Jul. 26, 1994

[54] ROLLING STAND, HAVING THREE OR MORE DRIVEN AND ADJUSTABLE ROLLERS

[75] Inventors: Vincenzo Palma, Sesto San Giovanni; Filippo Cattaneo, Milan; Ettore Cernuschi, Milan; Roberto Brioschi, Milan; Maurizio Brignoli, Romano Di Lombadia, all of Italy; Roger Bossoney, Bouchillon, Switzerland

[73] Assignee: Innse Innocenti Engineering, S.P.A., Genoa, Italy

[21] Appl. No.: 970,074

[22] Filed: Nov. 2, 1992

[30] Foreign Application Priority Data

Apr. 15, 1992 [IT] Italy ..... MI 92 A 000917

[51] Int. Cl.[5] ..... B21B 31/00

[52] U.S. Cl. ..... 74/224; 72/234; 72/237; 72/239

[58] Field of Search ..... 72/224, 234, 235, 237, 72/238, 239

[56] References Cited

U.S. PATENT DOCUMENTS

| | | | |
|---|---|---|---|
| 2,120,539 | 6/1938 | Barth | 72/238 |
| 3,842,635 | 10/1974 | Bibighaus | 72/224 |
| 4,038,855 | 8/1977 | Scheib | 72/235 |
| 4,522,051 | 6/1985 | Hayashi et al. | 72/235 |
| 4,537,054 | 8/1985 | Properzi | 72/238 |
| 4,622,841 | 11/1986 | Yoshida | 72/235 |

*Primary Examiner*—Lowell A Larson
*Assistant Examiner*—Thomas C. Schoeffler

[57] ABSTRACT

A rolling stand includes a roller-carrier substantially in the form of a ring-shaped body having the rollers journalled on its interior; the roller-carrier is slidable along a longitudinal rolling axis L between an operative position occupied during the rolling process, where it is locked inside an outer structure of the rolling stand, and a non-operative position where it is removed from the structure. Provided within the rolling stand are guide means for guiding the roller-carrier movement along the axis L and means of locking the roller-carrier in the operative position.

14 Claims, 5 Drawing Sheets

ROLLING STAND, HAVING THREE OR MORE DRIVEN AND ADJUSTABLE ROLLERS

FIELD OF THE INVENTION

This invention relates to a rolling stand having at least three driven rollers, an outer support structure for said rollers, driving means and associated mechanical transmission means for driving the rollers, said stand being placed along a longitudinal rolling axis.

Such a rolling stand has an application, in the current state of the art and with some obvious modifications to adapt it for different operating conditions, in machines employed to process steel and like products.

For example, a stand as the one above outlined is already known for wire, bar and the like rolling trains; it is known, moreover, in a substantially analogous form, for tube rolling mills. In either instance, such stands are used substantially for the same purpose, as explained hereinafter.

Further, reference will be made hereinafter only to stands for seamless tube rolling mills, specifically mandrel-type rolling mills, for brevity and convenience of illustration. Of course, as a consequence of the foregoing remarks about the different applications of this type of rolling stand, the considerations made hereinafter should be taken in a substantially universal sense and can be extended to the analogous machines which belong to the general state of the art and in which such stands are used.

Additionally, notice that the term "rolling stand" is used throughout this specification and the appended claims to designate that intermediate component of a rolling mill which accommodates rollers designed to apply their action to a product being rolled, be it a tube, a wire, a bar or other product.

BACKGROUND OF THE INVENTION

In general, in conventional seamless tube rolling mills, the rolling stands are structurally independent one from another and can be individually moved off the mill in order to allow their replacement. In a preferred embodiment, the rollers of such stands have coplanar axes of rotation which lie on a plane orthogonal to the rolling axis; such a rolling mill is commonly referred to as a continuous rolling mill.

In general, in the seamless tube making industry, it is recognized that proper performance of the rolling process is closely dependent on the action being applied by the roller grooves at each rolling stand.

More particularly, it is recognized that the geometric tolerance and the surface finish of a tube depend on the difference between the tube rate of advancement along the rolling axis and the peripheral speeds of the rollers as measured at several locations of the grooves, in contact with the tube.

The commercial production of seamless tubes is currently carried out mainly on mandrel-type continuous rolling mills having a set of successive stands each provided with two driven rollers; such rollers are supported by an external structure, opposite one another and have parallel axes of rotation. In this specific case, the contact of the tube to be processed with the groove of one such roller occurs approximately over one half the external circumference of the tube.

In recent years, on a purely experimental basis and alternatively to the above-mentioned approach, the feasibility of continuous rolling mills provided with rolling stands having more than two rollers was investigated.

In general, in the last-mentioned embodiment of the rolling mill, contact between the profile of the roller grooves and the tube to be processed occurs over an arc of said external circumference whose length is inversely proportional to the number of the rollers in each stand.

Thus, in the particular instance of a three-roller stand, the profiles of the roller grooves will be active over an arc being approximately one third the external circumference of the tube.

The development of rolling mills equipped with stands having more than two rollers is of great interest because it has been verified, both theoretically and experimentally, that the shorter the length of the tube arc being worked upon by a single roller, the better the resultant tube surface finish and thickness tolerances.

This explains the efforts being currently made in the art in order to provide rolling mills which embody this novel technological concept.

It should be considered, however, that while having more than two rollers enhances mill performance, as the number of the rollers in each rolling stand is increased, the technical difficulties encountered in engineering the rolling mill also increase significantly. As an example, the construction of three-roller stands already involves technical difficulties which have yet to be fully overcome; among these difficulties are the problems posed by simultaneously driving three rollers and adjusting their distances from the rolling axis.

In fact, three-roller stand mills tried or known heretofore fail to provide such adjustment feature to an adequate degree to make the rolling mills suitable for industrial applications; that is, the mills are too rigid, and unsuitable for coping with the different operating conditions required by the tubes, or pipes of industrial production.

SUMMARY OF THE INVENTION

It is the object of this invention to provide a rolling stand having at least three driven rollers, an external support structure for the rollers, driving means and associated mechanical transmission means for the rollers, which has such construction and performance features as to overcome the aforementioned drawbacks besetting the prior art.

These problems are solved by a rolling stand as indicated above and characterized in the appended claims.

BRIEF DESCRIPTION OF THE DRAWINGS

Further features and the advantages of this invention can be more clearly understood from the description of an embodiment thereof, to be taken by way of non-limitative example with reference to the accompanying drawings wherein.

DETAILED DESCRIPTION OF THE PREFERRED EMBODIMENTS

Figure 1:
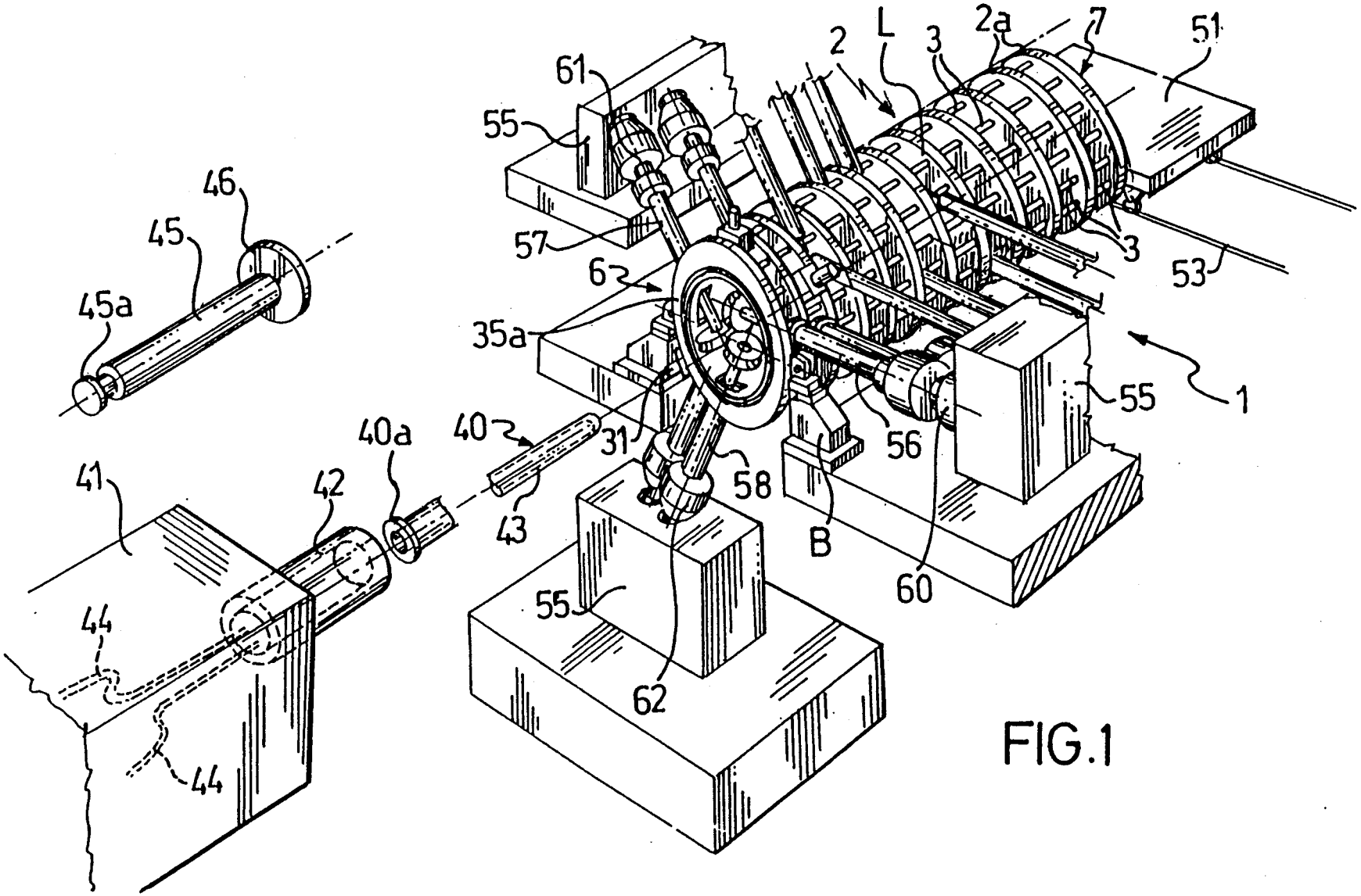
FIG. 1 is a simplified perspective view of a rolling mill incorporating stands according to the invention.

With reference to the drawing views and particularly to FIG. 1, generally shown at 1 is a rolling mill according to the invention intended for seamless tube making.

The rolling mill 1 comprises an outer main structure 2 which includes a plurality of flat annular elements 2*a* being laid side-by-side along a longitudinal axis of the rolling mill and interconnected rigidly by spacers 3 distributed around the periphery of the flat annular shape of said elements 2*a*.

Figure 2:
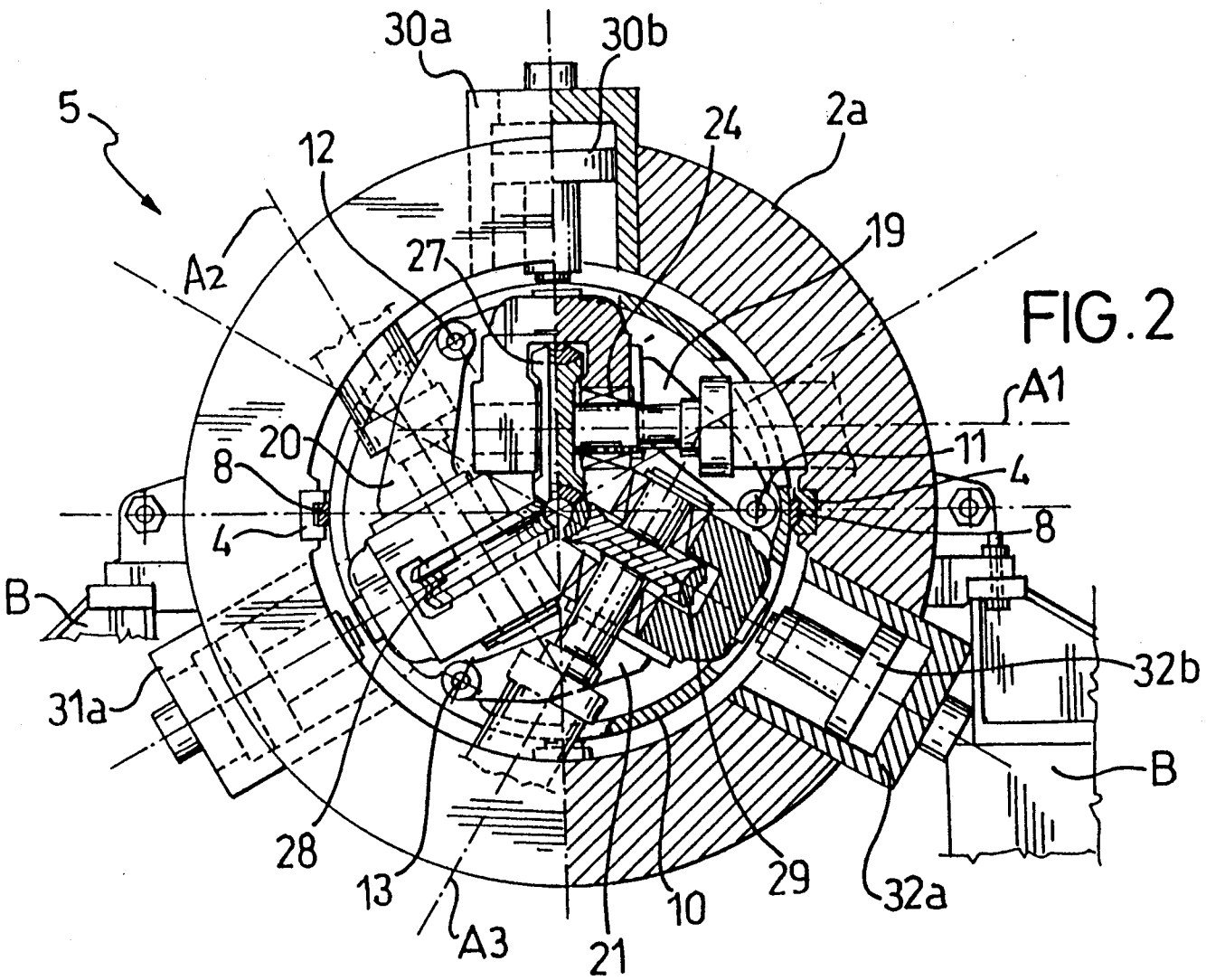
FIG. 2 is a half-sectioned front view of a stand in the rolling mill of FIG. 1.
Figure 3:
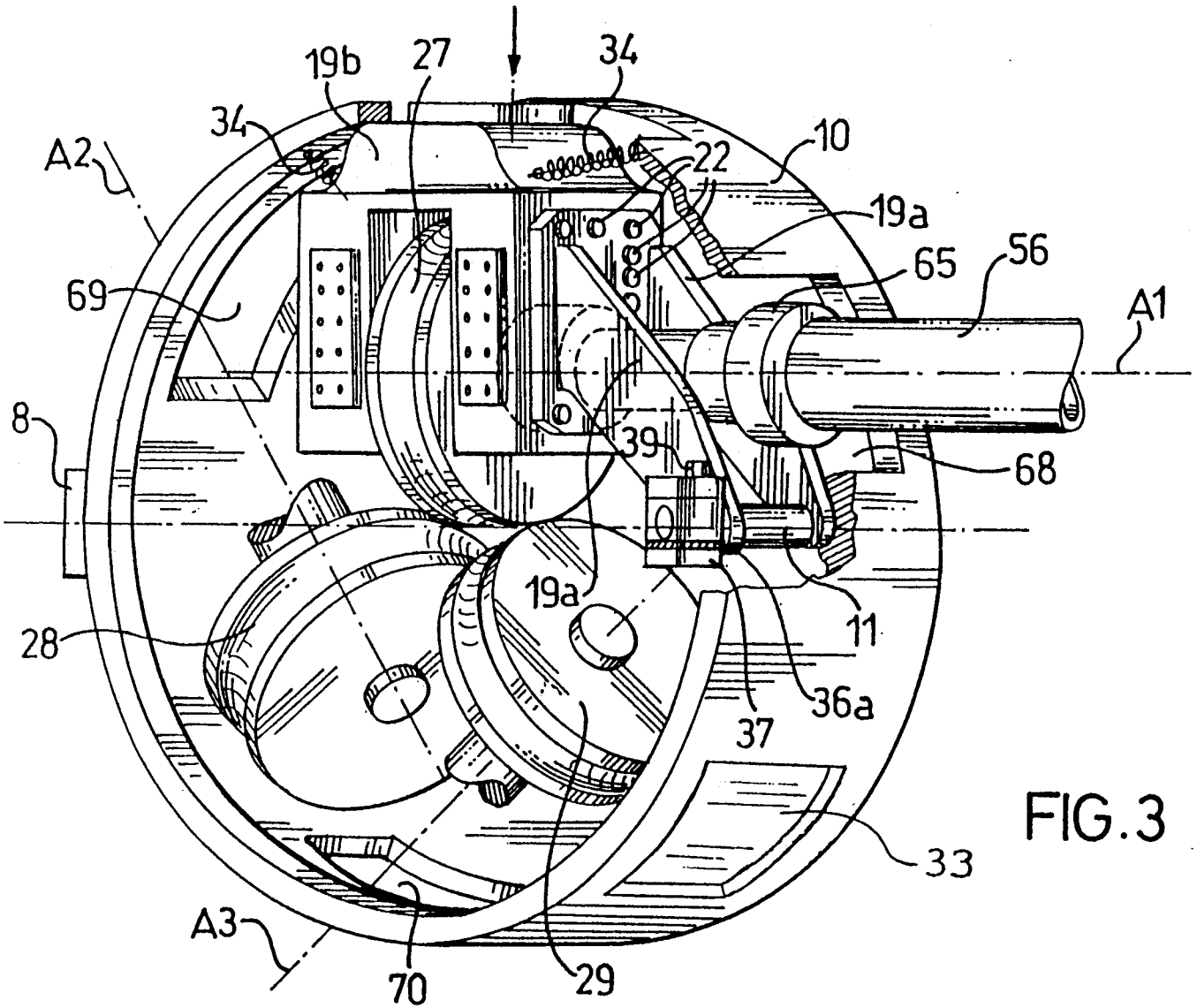
FIG. 3 is a cut away perspective view of a detail of the rolling stand shown in FIG. 2.

A pair of linear guide bearings 4 as shown in FIG. 2 extend inside the structure 2 parallel to the rolling axis L at the location of the inward edge of each said flat element 2*a*, whereto they are attached rigidly; in this example, the linear guide bearings 4 also extend diametrically opposite from each other.

The structure 2 is set on a base 13, and the rolling mill 1 is of a kind which comprises a plurality of rolling stands 5 laid along the longitudinal axis L of the mill 1, between tube inlet and outlet ends, 6 and 7 respectively. Said ends 6 and 7 located at respective opposite ends of the structure 2.

Specifically, in this embodiment of the invention, each rolling stand 5 includes two flat elements 2*a* laid side-by-side on the structure 2, and a roller-carrier 10 in the form of a ring-shaped body, being coaxial with the structure 2 and accommodated between two consecutive flat elements 2*a*.

More generally, in this embodiment of the rolling mill according to the invention, provided within the structure 2 are a plurality of said roller-carriers 10 packed together, each between two successive flat members on the structure 2.

In this embodiment of the invention, the linear guide bearings 4 are straight and engaged by a corresponding pair of projections 8 formed on the exterior part of each roller-carrier 10, the roller-carriers 10, additionally to being supported on those linear guide bearings 4, are slidable along these latter.

Secured on each roller-carrier 10, at the apices of an imaginary equilateral triangle drawn inside its circular cross-section, are three pivots 11, 12, 13 on which respective lever arms 19, 20, 21 are pivotally mounted.

Said pivots 11, 12 and 13 are respective fulcrum for the corresponding lever arms 19, 20 and 21, and are mounted adjustably to the roller-carrier 10 in a manner hereby explained.

In a preferred embodiment, the arms 19, 20 and 21 comprise two flat half-arms 19*a*, 20*a* and 21*a* which extend parallel to and opposite from each other and carry respective chocks 19*b*, 20*b* and 21*b*, the latter being adjustably secured to the arms on their side opposite to the pivots 11, 12 and 13.

In particular, each chock is fastened to its arm by bolts 22 which connect the chock to a plate 23 attached frontally to said flat half-arms; the plate 23 is suitably formed with slotted holes for engagement with the bolts 22.

Each chock 19*b*, 20*b* and 21*b* houses corresponding journal bearings 24, 25 and 26 for supporting respective rollers 27, 28 and 29; said rollers are revolving in their bearings, each about a respective axis A1, A2 and A3 of rotation.

For each of said rollers 27, 28, 29 on each rolling stand 5, there is provided an adjuster device 30, 31, 32, for setting the distance of each rotation axis A1, A2, A3 from the rolling axis L.

In this example of the invention, the adjuster devices 30, 31 and 32 are preferably hydraulically operated and each comprises an oil-operated cylinder-piston assembly having a stationary part 30*a*, 31*a*, 32*a*, respectively, which is attached rigidly to the structure 2 between a pair of side-by-side flat elements 2*a*, and a moving part 30*b*, 31*b* and 32*b* which is reciprocable, with reference the stationary part, along a radial direction passing through the rolling axis L.

Said moving part 30*b*, 31*b*, 32*b* passes through holes 33 provided on the periphery of the roller-carrier 10, and is active on a corresponding one of the arms 19, 20 and 21; the latter are held against said moving part 30*b*, 31*b*, 32*b* by conventional carrier means 34, in this embodiment of the invention made up by ordinary springs.

Advantageously, the roller-carriers 10 are accommodated within the structure 2 such that the reciprocation directions of the moving parts 30*b*, 31*b*, 32*b* of the adjuster devices 30, 31, 32 related to a roller-carrier 10, are rotated through 60° from the analogous directions of the moving parts of the adjuster devices 30, 31, 32 related to a roller-carrier adjacent in the package; in addition, each roller-carrier 10 would be turned upside-down with reference to the adjacent one in the package, about a perpendicular diameter to one of said directions of reciprocation of the moving parts 30*b*, 31*b* and 32*b*.

The rolling mill 1 is provided with conventional locking means 35 for keeping the roller-carriers 10 securely in their packed arrangement. The locking means 35 comprise, in this example, a bottom 35*a* of the structure 2 located at the inlet end 6 and a plurality of pivotable clamps 35*b* at the outlet end 7.

Figure 4:
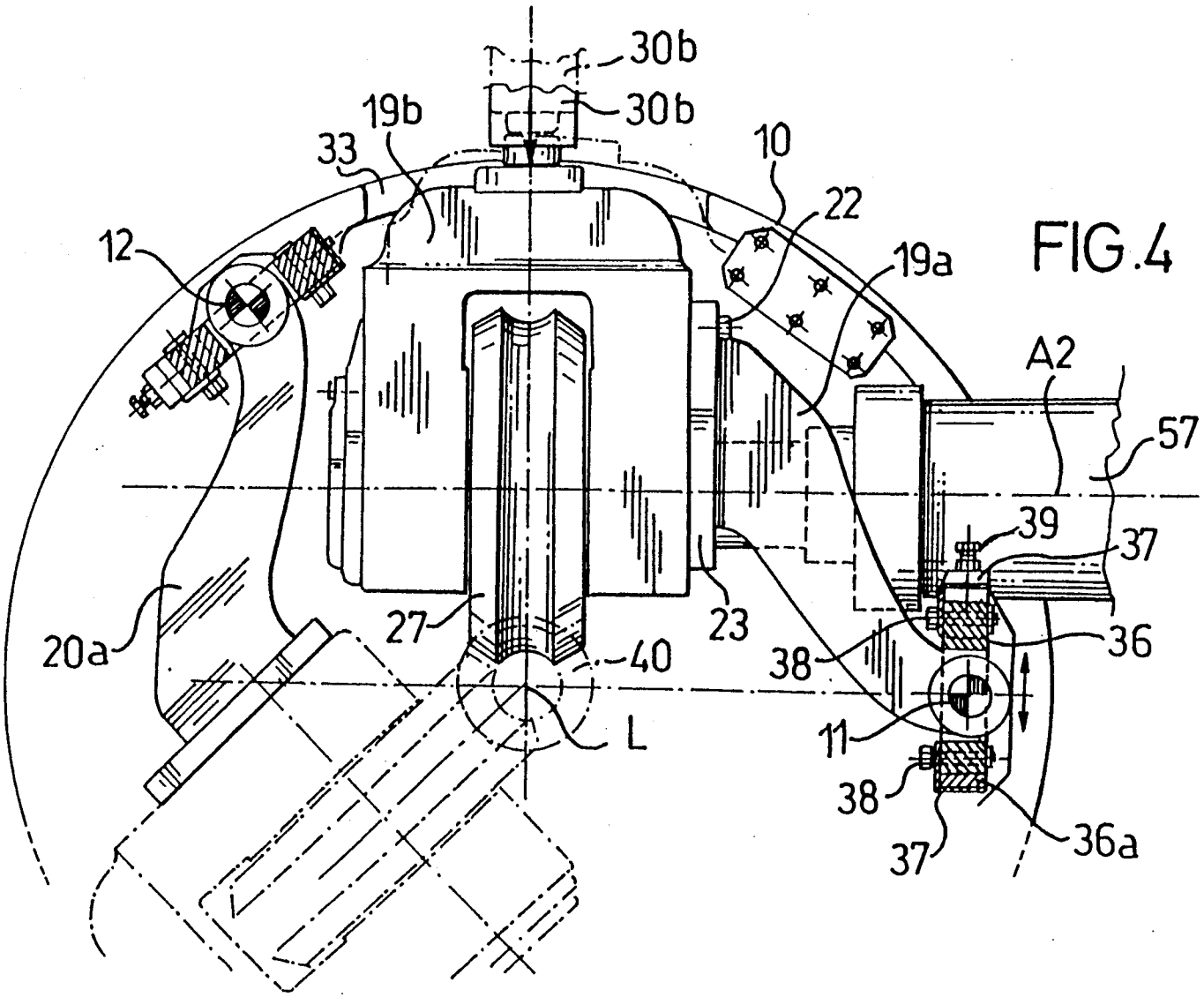
FIG. 4 is detail view of the rolling stand of FIG. 2, shown in different operational conditions.

In connection with the foregoing, the pivots 11, 12 and 13 are adjustable in position, and more precisely, they are mounted on supports 36 which are secured on a couple of brackets 37 attached to the roller-carrier 10 and extending toward the rolling axis L from opposite sides of the supports 36. A first pair of bolts 38 fasten the supports 36 frontally on the brackets 37 and a second pair of bolts 39 are arranged to tighten the supports 36 as explained herein below (see FIG. 4).

The pivots 11, 12, 13 are adjusted in position by adding or removing shims 36*a* underneath the supports 36 after loosening bolts 38 and 39; to this aim, the bolts 38 are passed through suitably slotted holes formed in the brackets 37, whereas bolts 39 are arranged to tighten the shims 36*a* onto the supports 36.

The rolling mill 1 further includes a mandrel 40 movable along the rolling axis L by means of conventional mechanisms 41, in this example, essentially made up of a rack-and-pinion arrangement schematically shown in the drawings.

Further in this particular instance, the rolling mill 1 is of the retained mandrel type and is provided, at the location of a tang 40*a* of the mandrel 40, with conventional retaining means 42; the latter comprise a spindle head in engagement with the mandrel tang 40*a*.

The mandrel 40 is also formed internally with a hollow 43 which is in fluid communication with a plurality of conduits 44 directing a fluid coolant into the hollow, the coolant fluid being supplied by a pump means, not shown.

The rolling mill of this invention further includes tool 45 for replacing the stands 5, which can be applied to the spindle head 42 instead of the mandrel 40. Specifically, the tool 45 is also provided with retaining means consisting of a tang 45*a* similar to the aforementioned one and, in addition, a disc 46 releasably attachable to the tool 45 at an end opposed to the tang 45*a*.

Provided adjacent to the outlet end 7 of the rolling mill 1 is a device for loading-unloading the rolling stands 5 which comprises a platform 51 movable along rails 53 laying transverse to the rolling axis in the same plane of the base B.

The rolling mill of this invention is equipped with a plurality of conventional driving means 55, each adapted to drive one or more rollers in a respective rolling stand 5. In particular, the driving means 55 are coupled, in this embodiment, each to a respective one of the rollers 27, 28, 29 of each stand 5 by means of corresponding shafts 56, 57, 58 provided with swivel connection means 60, 61, 62, such as a cardan joint or the like, effective to let the motion be transferred at any settings of the rollers.

Also, the shafts 56, 57 and 58 incorporate conventional joint means 65 for releasably coupling each roller 27, 28 and 29 to its respective shaft.

Lastly, for coupling the shafts 56, 57 and 58 to their corresponding rollers 27, 28 and 29 of each stand 5, each roller-carrier 10 is formed with holes 68, 69 and 70 through which said shafts are passed.

The operation of a rolling mill according to the invention will now be described with reference to a starting condition wherein a tubular blank piece, not shown, to be rolled is being processed using a respective mandrel 40 held in the means 42; accordingly, the blank piece will be extending through the rollers 27, 28, 29 of several rolling stands 5.

It should be noted first that the outer structure 2, being a closed structure, applies a reaction which compensates and restrains the roller separating forces developed during the rolling process, to prevent them from being transferred to the base 8 and its environment.

This is accomplished by the roller adjuster devices 30, 31, 32 of each rolling stand 5 being secured with their respective stationary parts 30*a*, 31*a*, 32*a* on the structure 2. In fact, the rolling forces applied to the rollers 27, 28, 29 by the blank piece is transferred, through the bearings 24, 25, 26, to the corresponding chock 19*b*, 20*b*, 21*b* of the lever arm 19, 20, 21. Thence, the rolling force is transferred to the moving part 30*b*, 31*b*, 32*b* of the respective adjuster devices 30, 31, 32. Finally, the moving parts 30*b*, 31*b* and 32*b* transfer the thrust acting on it to the stationary part 30*a*, 31*a*, 32*a*, and hence to the same flat members 2*a* on which that stationary part is mounted.

Advantageously, moreover, the outer structure 2 has an overall geometric form of the cylindrical or tubular kind which can better spread the aforesaid rolling forces over its entire extent.

Notice that by having the rolling forces transferred to the general outer structure 2, the roller-carriers can be made lighter since, being relieved of radial loads from the rolling process, they purely have now a roller supporting function. This makes possible easy displacement of the same along the linear guide bearings 4 and, more generally, easier replacement operations of the roller-carriers.

In the latter respect, on a rolling mill according to the invention, the rollers of the stands can be exchanged by working along a longitudinal direction parallel to the rolling axis, rather than along radial directions to that axis, as it is generally the case in the prior art.

The rollers can be exchanged, in fact, by exchanging one or more of the rollers-carriers 10, with the roller-carriers being removed from their packed arrangement upon release of their connection to the respective shafts. This operation is carried out after releasing the clamps 35*b* which lock the roller-carriers in their packed arrangement.

Thereafter, the mandrel 40 is replaced with the tool 45, which is inserted into the structure 2 likewise to the mandrel 40 and driven by the means 41; it will push the package of roller-carriers 10 toward the outlet end 7 of the rolling mill. The load-unload device 50 will then receive the roller-carriers removed from the structure 2 allowing them to be taken away and replaced with new carriers.

Figure 5:
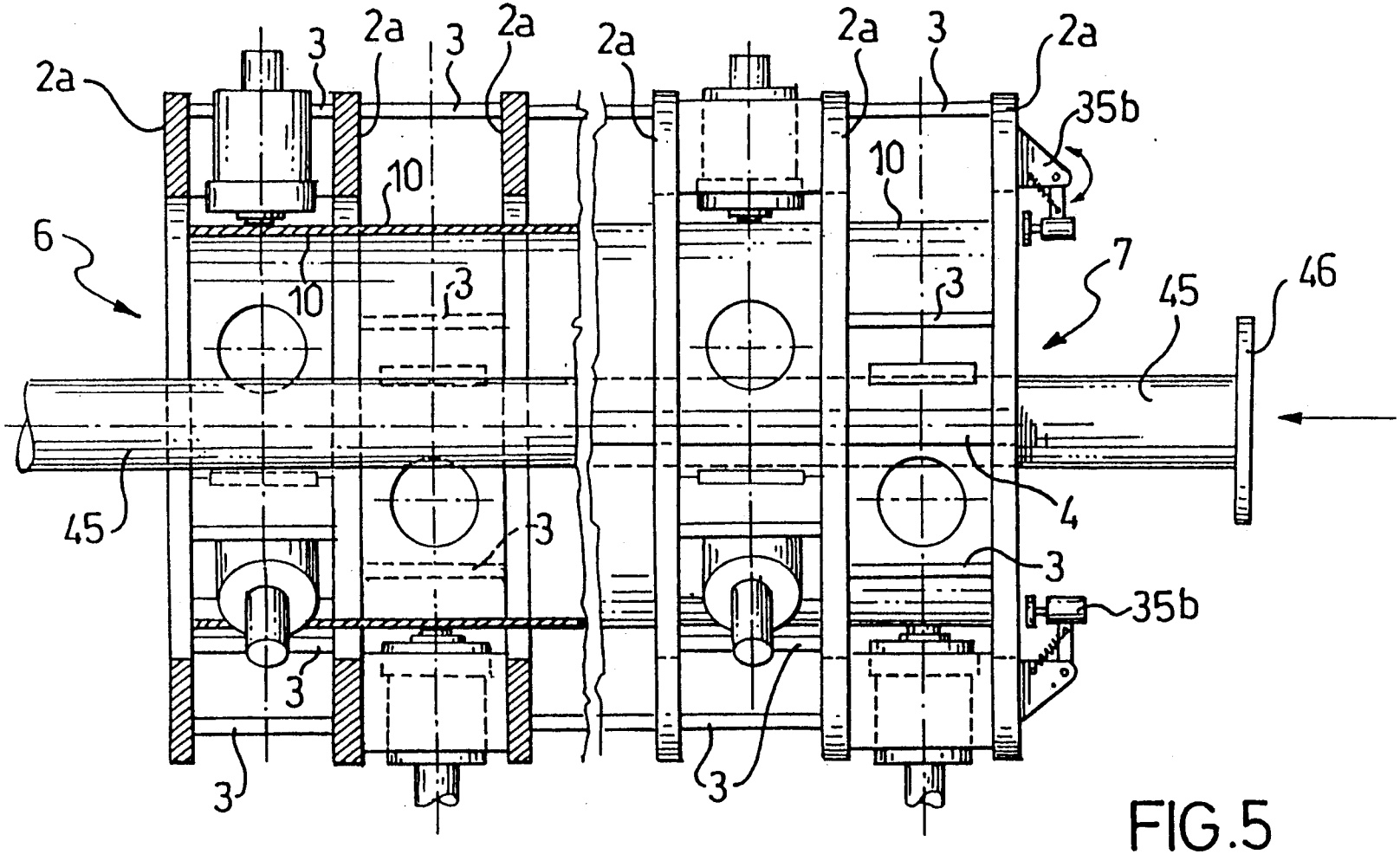
FIG. 5 is a sectioned side view of the rolling mill shown in FIG. 1.

To fit the latter on the rolling mill, the tool 45 is first inserted between the rollers of the replacement roller-carriers aligned on the platform 51 with the disc 46 removed. Thereafter, the disc 46 is re-attached to the tool 45 and the tool is pulled axially (see FIG. 5) into the structure 2 to drag the replacement roller-carriers therealong toward the structure interior.

Notice that the rolling mill of this invention affords great width of adjustment of the distance of the rotation axes A1, A2 and A3 for the rollers 27, 28 and 29 from the longitudinal axis L of the rolling mill 1.

Indeed, by using the devices 30, 31 and 32 and pivoting a respective one of the lever arms 19, 20 and 21 about its corresponding fulcrum center represented by the pivots 11, 12, 13, an accurate setting can be provided to respond to small variations in the dimensions of the tube workpiece. The positional adjustment of the pivots 11, 12 and 13 with reference to the roller-carrier 10, permits optimum adjustments of the roller even with wide adjustment ranges, such as the ones required for resetting rollers after that they have been returned off-line.

Of course, whereas the adjustments to be made with devices 30, 31 and 32 would be applied with the rolling mill and the roller-carriers 10 set ready for the rolling process, or during the latter, the adjustments of pivots 11, 12 and 13 would be effected with the roller-carriers 10 removed from the mill.

For this reason, the last mentioned operation would be essentially effective for large variations in the roller size due to wear or returning.

Further, a rolling mill according to the invention can use a mandrel resisting lower mechanical stresses than prior art mandrels; this is allowed by the provision of three-roller stands that load the mandrel in a more even and better balanced fashion. This fact enables a hollow construction for the mandrel with a peripheral outer wall which can be significantly thinner than all of the other prior art hollow mandrels.

It follows that the mandrel can be cooled in an excellent manner, thereby it will require no replacement during subsequent working cycles; this results in lower mandrel supply requirements for a given production and, therefore, lower investment costs for that supply.

Understandably, the embodiment of the rolling stand just described can be modified without affecting, however, the essence of its basic features. For example, the roller mounting to the respective pivoted arms on the roller-carriers could be alternatively performed by providing linear supporting tracks for the rollers chocks which extend toward the center of the roller-carrier. In this case, the arrangement for setting the distances of the roller axes from the rolling axis would remain substantially unchanged: that is, there would still be provided a stationary part and a moving part, with the former respectively attached to the structure 2 and the latter to the roller chock.

Further, it could be possible to provide a different design for the adjuster devices 30, 31 and 32: for example, an electromechanical conventional adjuster device could be used, which comprises a stationary part to be fastened to the outer structure of the rolling mill in accordance with the above teaching and a moving part reciprocable along a direction radial to the mill.

Another variant of the example previously described and illustrated could foresee that the rollers of each stand be driven, rather than by an independent single motor, by one or more main motors and a set of appropriate transmission mechanisms.

More generally, in connection with the roller driving arrangement, it could be thought of devising an infinite number of combinations using conventional means such as differential gears, bevel gears, transmissions, and whatever else, thus providing an almost infinite range of constructional solutions to suit different logistic conditions under which the rolling mill may have to be operated.

Further, also as it regards the accommodation of the roller-carriers within the structure 2, and more particularly of each rolling stand 5, all those variants should be taken into consideration which can be increased by using, instead of the previously described linear guide bearings and projections, such friction eliminating means as skids, rolling bearings, and the like, running in tracks to be possibly formed on the stands themselves or the roller-carriers.

It should be also noted that, as it regards the means for pulling the roller-carriers 10 out of the structure 2 of the rolling mill, in the example described above a tool 45 has been provided which has the interesting advantage that it can be applied in substitution of the mandrel; this enables the same means to be used for driving that tool as to drive the mandrel, with obvious positives advantages. In any case, it cannot be excluded that the aforesaid tool be replaced with some other conventional device as long as these can achieve the same result.

Lastly, it is to be observed that the number of the flat annular elements 2*a* that go into each rolling stand and, of course, the number of the stands which comprise a rolling mill may be varied. In particular, for each rolling stand, there are provided two said flat annular elements 2*a*, but their number constitutes no constraint so long as suitable measures are taken to allow the rollers to be coupled to their driving shafts or, more generally, to their driving means.

Finally, it should be emphasized that the solution of the aforementioned technical problem represented by this invention, obviously is not only useful for the rolling mill with a mandrel for seamless tubes rolling, of the previous example.

In fact, it refers to all tube rolling mills, whether with or without a mandrel, as well as wire, bar, flat bloom, and the like mills, wherein the teaching which derives from the stand of this invention would afford substantially the same advantages as pointed out hereinabove, and possibly some additional ones.

It should be also considered that, in an innovative stage, this invention could be also used on machines different from those mentioned above, wherein rolling stands with three or more rollers have never been employed before.

This reference applies, for instance, to tube gauging machines or tube straighteners. It should be indeed considered that it is unnecessary for the enhancement of this invention that the axes of rotation of the rollers of each stand be coplanar with one another, and they could be set askew as in the straighteners just mentioned.

We claim:

1. A rolling stand, having a longitudinal rolling axis, comprising:

at least three driven rollers;

an outer support structure for said rollers;

driving means and associated transmission means for driving said rollers;

a roller-carrier substantially in the form of a cylindrical body, wherein said rollers are each supported rotatable about a respective rotation axis via supporting means and carrier means provided in said roller-carrier for supporting each of said rollers in a pivotable manner;

said roller-carrier being slidably supported within said outer support structure such that the roller-carrier is slidable along said longitudinal rolling axis between an operative position locked within said outer support structure and a nonoperative position removed from said outer support structure via sliding means and locking means provided in the rolling stand;

at least one adjuster device for each roller, each adjuster device being operative to set a distance between said rotation axis of a respective roller and said longitudinal rolling axis, each adjuster device comprising a stationary part rigidly connected to said outer structure and a moving part reciprocable along a radial direction relative to said longitudinal rolling axis, said moving operating on said supporting means of the respective roller, and said carrier means holding said supporting means pressed against said moving part of each adjuster device.

2. The rolling stand of claim 1, wherein said outer support structure is of a substantially tubular type and comprises at least two annular flat elements coaxial with the longitudinal rolling axis and set side-by-side between an inlet and an outlet end of a workpiece to be rolled through the rolling stand, said annular flat elements being interconnected rigidly by a plurality of spacers, said roller-carrier being slidably supported within the annular flat elements.

3. The rolling stand of claim 2, wherein said sliding means for guiding roller-carrier movement comprises at least one pair of linear guide bearings extending parallel to the longitudinal rolling axis and attached to an inside surface of said flat annular elements, said linear guide bearings engaging corresponding projections formed on an exterior of said roller-carrier.

4. The rolling stand of claim 3, wherein said rollers are journalled on respective pairs of parallel linear tracks secured to the roller-carrier and extending toward said longitudinal rolling axis.

5. The rolling stand of claim 3, wherein said supporting means for the rollers comprises:

three lever arms, said lever arms having first ends mounted pivotally on respective pivots attached to said roller-carrier at apices of an imaginary equilateral triangle drawn inside a cross-section of said roller-carrier, said lever arms extending longitudinally inwards of said cross-section of the roller-carrier;

journal bearings respectively mounted on second ends of said lever arms opposite to the pivots, said driven rollers being mounted in said journal bearings; and wherein each adjuster device operates on the lever arm of each respective driven roller.

6. The rolling stand of claim 5, wherein said pivots are secured adjustably on said roller-carrier via support and adjustment means provided for each of the pivots.

7. The rolling stand of claim 6, wherein said moving parts of said adjuster devices pass through corresponding holes provided in said cylindrical body of the roller-carrier.

8. The rolling stand of claim 7, wherein each lever arm comprises: two parallel flat half-arms; one end of each half-arm being attached to one of said pivots and an opposite end of each half-arm being provided with a plate; a chock fastened rigidly to said plate by means of bolts, said journal bearings being housed within said chocks.

9. The rolling stand of claim 8, wherein each of said chocks is secured adjustably on the plate by means of bolts engaged in slotted holes formed through the plate.

10. The rolling stand of claim 9, wherein said adjuster devices are of a hydraulic type.

11. The rolling stand of claim 9, wherein said adjuster devices are of an electromechanical type.

12. A tube rolling mill, comprising: a plurality of rolling stands as recited in claim 1 laid side-by-side along a longitudinal rolling axis; a mandrel; retaining means for retaining said mandrel; and a moving mechanism connected to said retaining means for moving said mandrel.

13. The rolling mill of claim 12, further comprising a load-unload device for roller-carriers provided on a tube outlet end of the rolling mill, said load-unload device comprising a platform movable on rails.

14. The rolling mill of claim 13, further comprising a tool having a tang adapted to fit in said retaining means, said tool being driven by said moving mechanism provided on the rolling mill, said tool being along said longitudinal rolling axis to displace the roller-carriers along the guide bearings.

* * * * *